US009322556B2

(12) United States Patent
Melton et al.

(10) Patent No.: US 9,322,556 B2
(45) Date of Patent: Apr. 26, 2016

(54) FLOW SLEEVE ASSEMBLY FOR A COMBUSTION MODULE OF A GAS TURBINE COMBUSTOR

(71) Applicant: General Electric Company, Schenectady, NY (US)

(72) Inventors: Patrick Benedict Melton, Horse Shoe, NC (US); Lucas John Stoia, Taylors, SC (US); Richard Martin DiCintio, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 581 days.

(21) Appl. No.: 13/845,378

(22) Filed: Mar. 18, 2013

(65) Prior Publication Data

US 2014/0260275 A1 Sep. 18, 2014

(51) Int. Cl.

| | |
|---|---|
| ***F02C 1/00*** | (2006.01) |
| ***F23R 3/20*** | (2006.01) |
| ***F23R 3/00*** | (2006.01) |
| ***F01D 9/02*** | (2006.01) |
| *F23R 3/60* | (2006.01) |

(52) U.S. Cl.

CPC . *F23R 3/20* (2013.01); *F01D 9/023* (2013.01); *F23R 3/002* (2013.01); *F23R 3/60* (2013.01)

(58) Field of Classification Search

CPC ..... F02C 7/228; F02C 7/08; F23R 3/34; F23R 3/346; F23R 3/40; F23R 3/005; F23C 13/06; F23C 13/00; F23C 2900/13002

See application file for complete search history.

(56) References Cited

U.S. PATENT DOCUMENTS

| | | | | |
|---|---|---|---|---|
| 3,872,664 | A | 3/1975 | Lohmann | |
| 4,265,615 | A | 5/1981 | Lohmann | |
| 4,420,929 | A | 12/1983 | Jorgensen | |
| 5,069,029 | A | 12/1991 | Kuroda | |
| 5,380,154 | A * | 1/1995 | Norton | F01D 25/246 415/200 |
| 5,450,725 | A | 9/1995 | Takahara | |
| 5,475,979 | A | 12/1995 | Oag | |
| 5,802,854 | A | 9/1998 | Maeda | |

(Continued)

FOREIGN PATENT DOCUMENTS

| | | | |
|---|---|---|---|
| EP | 0526058 | A1 | 3/1993 |
| EP | 0578461 | A1 | 12/1994 |
| EP | 1884297 | A1 | 2/2008 |

OTHER PUBLICATIONS

Co-Pending U.S. Appl. No. 13/845,439, dated Mar. 18, 2013.

(Continued)

*Primary Examiner* — Gerald L Sung

(74) *Attorney, Agent, or Firm* — Dority & Manning, PA

(57) ABSTRACT

A flow sleeve assembly for a combustor of a gas turbine includes an annular support sleeve disposed at a forward end of the flow sleeve assembly. The support sleeve includes a forward portion axially separated from an aft portion. An aft frame is disposed at an aft end of the flow sleeve assembly. An annular flow sleeve extends from the aft portion of the support sleeve towards the aft frame. The flow sleeve includes a forward end that is axially separated from an aft end. The forward end of the flow sleeve circumferentially surrounds the aft end of the support sleeve. An annular impingement sleeve extends between the aft end of the flow sleeve and the aft frame. A forward end of the impingement sleeve is connected to the aft end of the flow sleeve, and an aft end of the impingement sleeve is connected to the aft frame.

18 Claims, 7 Drawing Sheets

(56) References Cited

U.S. PATENT DOCUMENTS

| | | | | |
|---|---|---|---|---|
| 6,047,550 | A | 4/2000 | Beebe | |
| 6,148,604 | A | 11/2000 | Salt | |
| 6,212,870 | B1 | 4/2001 | Thompson et al. | |
| 6,374,594 | B1 | 4/2002 | Kraft et al. | |
| 6,442,946 | B1 | 9/2002 | Kraft | |
| 6,450,762 | B1 | 9/2002 | Munshi | |
| 6,543,993 | B2 | 4/2003 | Burdgick et al. | |
| 6,654,710 | B1 | 11/2003 | Keller | |
| 6,875,009 | B2 | 4/2005 | Kayahara et al. | |
| 6,896,509 | B2 | 5/2005 | Carroni et al. | |
| 6,957,949 | B2 | 10/2005 | Hyde et al. | |
| 7,082,766 | B1 | 8/2006 | Widener et al. | |
| 7,743,612 | B2 | 6/2010 | Morenko | |
| 8,096,131 | B2 | 1/2012 | Ziaei et al. | |
| 8,158,428 | B1 | 4/2012 | Krishna | |
| 8,171,738 | B2 | 5/2012 | Fish et al. | |
| 2002/0184893 | A1 | 12/2002 | Farmer | |
| 2003/0039542 | A1 | 2/2003 | Cromer | |
| 2005/0044855 | A1* | 3/2005 | Crawley | F23R 3/283 60/752 |
| 2005/0241317 | A1 | 11/2005 | Martling | |
| 2005/0268617 | A1 | 12/2005 | Amond | |
| 2008/0282667 | A1 | 11/2008 | Intile | |
| 2009/0071157 | A1 | 3/2009 | Cai | |
| 2009/0199561 | A1 | 8/2009 | Hessler | |
| 2010/0054928 | A1 | 3/2010 | Schiavo | |
| 2010/0071377 | A1 | 3/2010 | Fox | |
| 2010/0139283 | A1 | 6/2010 | Phillips et al. | |
| 2010/0170216 | A1 | 7/2010 | Venkataraman | |
| 2010/0174466 | A1 | 7/2010 | Davis, Jr. et al. | |
| 2010/0263386 | A1 | 10/2010 | Edwards | |
| 2011/0067402 | A1 | 3/2011 | Wiebe | |
| 2011/0146284 | A1* | 6/2011 | Morimoto | B23K 1/0018 60/737 |
| 2011/0247314 | A1* | 10/2011 | Chila | F23R 3/346 60/39.281 |
| 2011/0304104 | A1 | 12/2011 | McMahan | |
| 2012/0186260 | A1 | 7/2012 | DiCintio et al. | |
| 2012/0210729 | A1 | 8/2012 | Cihlar et al. | |
| 2012/0304648 | A1 | 12/2012 | Byrne | |
| 2014/0033728 | A1 | 2/2014 | Marmilic | |
| 2014/0260272 | A1 | 9/2014 | DiCintio | |

OTHER PUBLICATIONS

Co-Pending U.S. Appl. No. 13/845,365, dated Mar. 18, 2013.
Co-Pending U.S. Appl. No. 13/845,485, dated Mar. 18, 2013.
Co-Pending U.S. Appl. No. 13/845,565, dated Mar. 18, 2013.
Co-Pending U.S. Appl. No. 13/845,617, dated Mar. 18, 2013.
Co-Pending U.S. Appl. No. 13/845,661, dated Mar. 18, 2013.
Co-Pending U.S. Appl. No. 13/845,699, dated Mar. 18, 2013.
Co-Pending U.S. Appl. No. 13/845,384, dated Mar. 18, 2013.

* cited by examiner

FLOW SLEEVE ASSEMBLY FOR A COMBUSTION MODULE OF A GAS TURBINE COMBUSTOR

FIELD OF THE INVENTION

The present invention generally involves a combustor for a gas turbine. More specifically, the invention relates to a flow sleeve assembly for a combustion module of the combustor.

BACKGROUND OF THE INVENTION

A typical gas turbine that is used to generate electrical power includes an axial compressor, one or more combustors downstream from the compressor, and a turbine that is downstream from the combustors. Ambient air is supplied to the compressor, and rotating blades and stationary vanes in the compressor progressively impart kinetic energy to the working fluid (air) to produce a compressed working fluid at a highly energized state. The compressed working fluid exits the compressor and flows towards a head end of combustor where it reverses direction at an end cover and flows through the one or more fuel nozzles into a primary combustion zone that is defined within a combustion chamber in each combustor. The compressed working fluid mixes with fuel in the one or more fuel nozzles and/or within the combustion chamber and ignites to generate combustion gases having a high temperature and pressure. The combustion gases expand in the turbine to produce work. For example, expansion of the combustion gases in the turbine may rotate a shaft connected to a generator to produce electricity.

A typical combustor includes an end cover coupled to a compressor discharge casing, an annular cap assembly that extends radially and axially within the compressor discharge casing, an annular combustion liner that extends downstream from the cap assembly, an annular flow sleeve that circumferentially surrounds the combustion liner, and a transition piece that extends downstream from the combustion liner. The transition piece generally includes an annular transition duct that extends between the combustion liner and a first stage of stationary nozzles, and an impingement sleeve that circumferentially surrounds the transition duct. An aft end of the transition piece is typically connected to an outer casing such as a turbine or compressor discharge casing. A forward end of the flow sleeve circumferentially surrounds an outer portion of the cap assembly. The forward end is rigidly fixed in position to the outer portion of the cap assembly using one or more fasteners. The aft end of the transition piece at least partially supports the liner, the flow sleeve and the cap assembly.

Although the rigid connection between the flow sleeve and the cap assembly described above is generally effective for many existing combustors, it is generally ineffective for a combustor having a combustion module which includes a fuel distribution manifold at a forward end and a fuel injection assembly that extends downstream from the fuel distribution manifold. The fuel distribution manifold partially surrounds a cap assembly within the combustor. The fuel injection assembly generally includes a flow sleeve and/or an impingement sleeve that circumferentially surrounds at least a portion of a combustion liner. A forward end of the combustion liner surrounds a downstream end of the cap assembly. The fuel distribution manifold may be connected to a first outer casing such as a compressor discharge casing and the aft end of the fuel injection assembly is connected to a second outer casing such as an outer turbine casing. The fuel distribution manifold provides structural support to the forward end of the fuel injection assembly. In particular, the fuel distribution manifold provides structural support to a forward end of flow sleeve.

As the gas turbine transitions through various operating conditions such as during start-up, turn-down and/or shutdown, the combustion module, the first outer casing and the second outer casing transition through various thermal transients which results in varying rates of thermal growth between the first and second outer casings and the combustion module. Accordingly, the combustion module must accommodate for relative motion between the fuel distribution manifold and the fuel injector assembly. As a result, a rigid connection between the flow sleeve and the cap assembly of a combustor having a combustion module is not a viable option. Therefore, an improved flow sleeve assembly would be useful.

BRIEF DESCRIPTION OF THE INVENTION

Aspects and advantages of the invention are set forth below in the following description, or may be obvious from the description, or may be learned through practice of the invention.

One embodiment of the present invention is a flow sleeve assembly for a combustor of a gas turbine. The flow sleeve assembly includes an annular support sleeve that is disposed at a forward end of the flow sleeve assembly. The support sleeve includes a forward portion that is axially separated from an aft portion. An aft frame is disposed at an aft end of the flow sleeve assembly. An annular flow sleeve extends from the aft portion of the support sleeve towards the aft frame. The flow sleeve includes a forward end that is axially separated from an aft end. The forward end of the flow sleeve circumferentially surrounds the aft end of the support sleeve. An annular impingement sleeve extends between the aft end of the flow sleeve and the aft frame. The impingement sleeve includes a forward end that is connected to the aft end of the flow sleeve and an aft end that is connected to the aft frame.

Another embodiment of the present invention is a combustion module for a combustor. The combustion module includes an annular fuel distribution manifold. The fuel distribution manifold includes a forward end that is axially separated from an aft end. The combustion module further includes a fuel injection assembly that extends downstream from the fuel distribution manifold. The fuel injection assembly includes an annular combustion liner that extends between a forward end and an aft end of the fuel injection assembly and an annular flow sleeve assembly that circumferentially surrounds the combustion liner. The flow sleeve assembly includes an annular support sleeve that is disposed at a forward end of the flow sleeve assembly. The support sleeve has a forward portion that is axially separated from an aft portion. An aft frame is disposed at an aft end of the flow sleeve assembly. An annular flow sleeve extends from the aft portion of the support sleeve towards the aft frame. The flow sleeve includes a forward end that is axially separated from an aft end. An annular impingement sleeve extends between the aft end of the flow sleeve and the aft frame. The impingement sleeve includes a forward end that is connected to the aft end of the flow sleeve and an aft end that is connected to the aft frame.

The present invention may also include a gas turbine having a compressor disposed at an upstream end of the gas turbine, a combustor disposed downstream from the compressor, a turbine disposed downstream from the combustor; and a combustion module that extends at least partially through the combustor. The combustion module includes an annular fuel distribution manifold having a forward end that is axially separated from an aft end and a fuel injection assembly that extends downstream from the fuel distribution manifold. The fuel injection assembly includes an annular combustion liner that extends between a forward end and an aft end of the fuel injection assembly and an annular flow sleeve assembly that circumferentially surrounds the combustion liner. The flow sleeve assembly comprises an annular support sleeve that is disposed at a forward end of the flow sleeve assembly. The support sleeve includes a forward portion that is axially separated from an aft portion. An aft frame is disposed at an aft end of the flow sleeve assembly. An annular flow sleeve extends from the aft portion of the support sleeve towards the aft frame. The flow sleeve includes a forward end that is axially separated from an aft end. An annular impingement sleeve extends between the aft end of the flow sleeve and the aft frame. The impingement sleeve includes a forward end that is connected to the aft end of the flow sleeve and an aft end that is connected to the aft frame.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
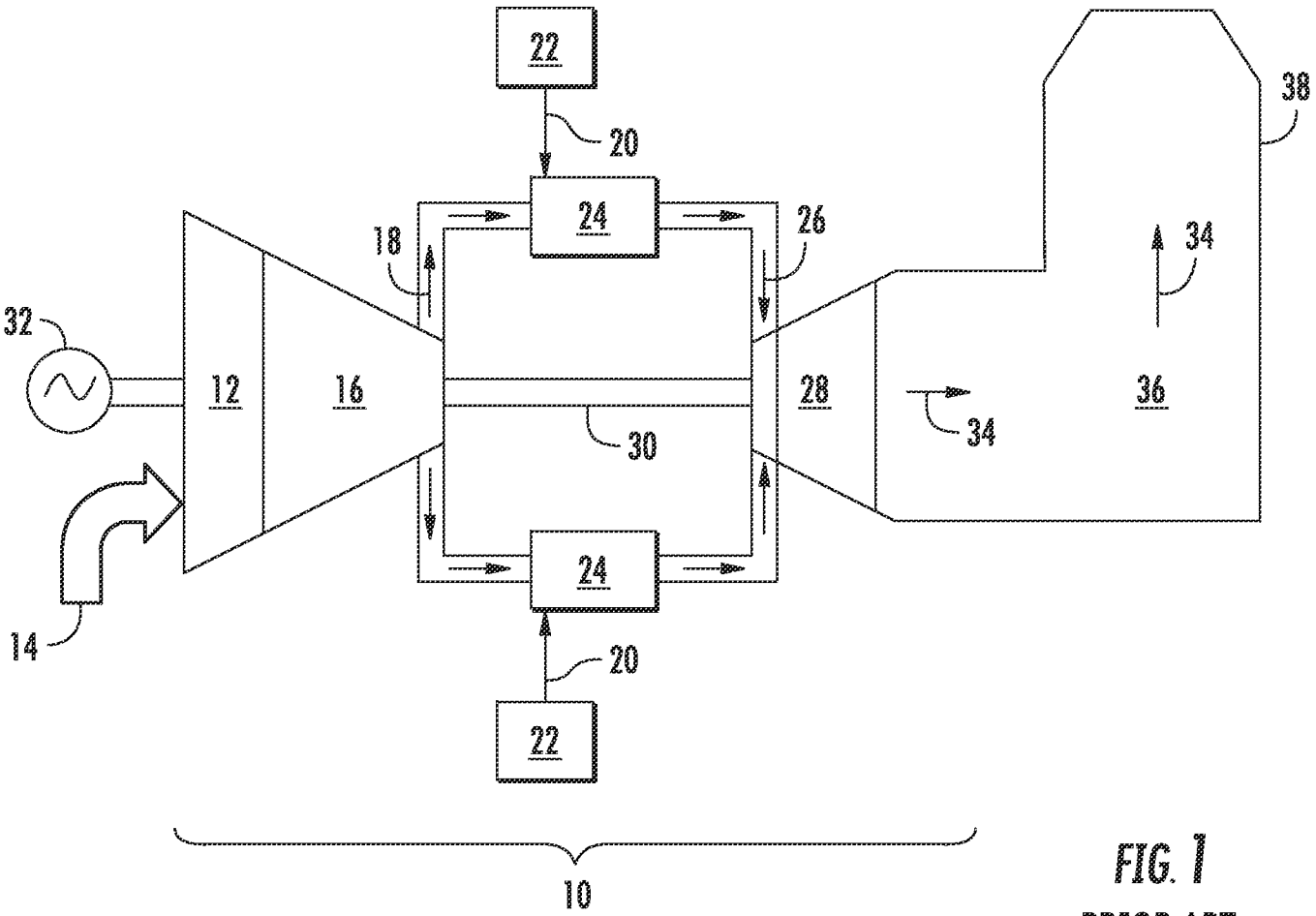
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
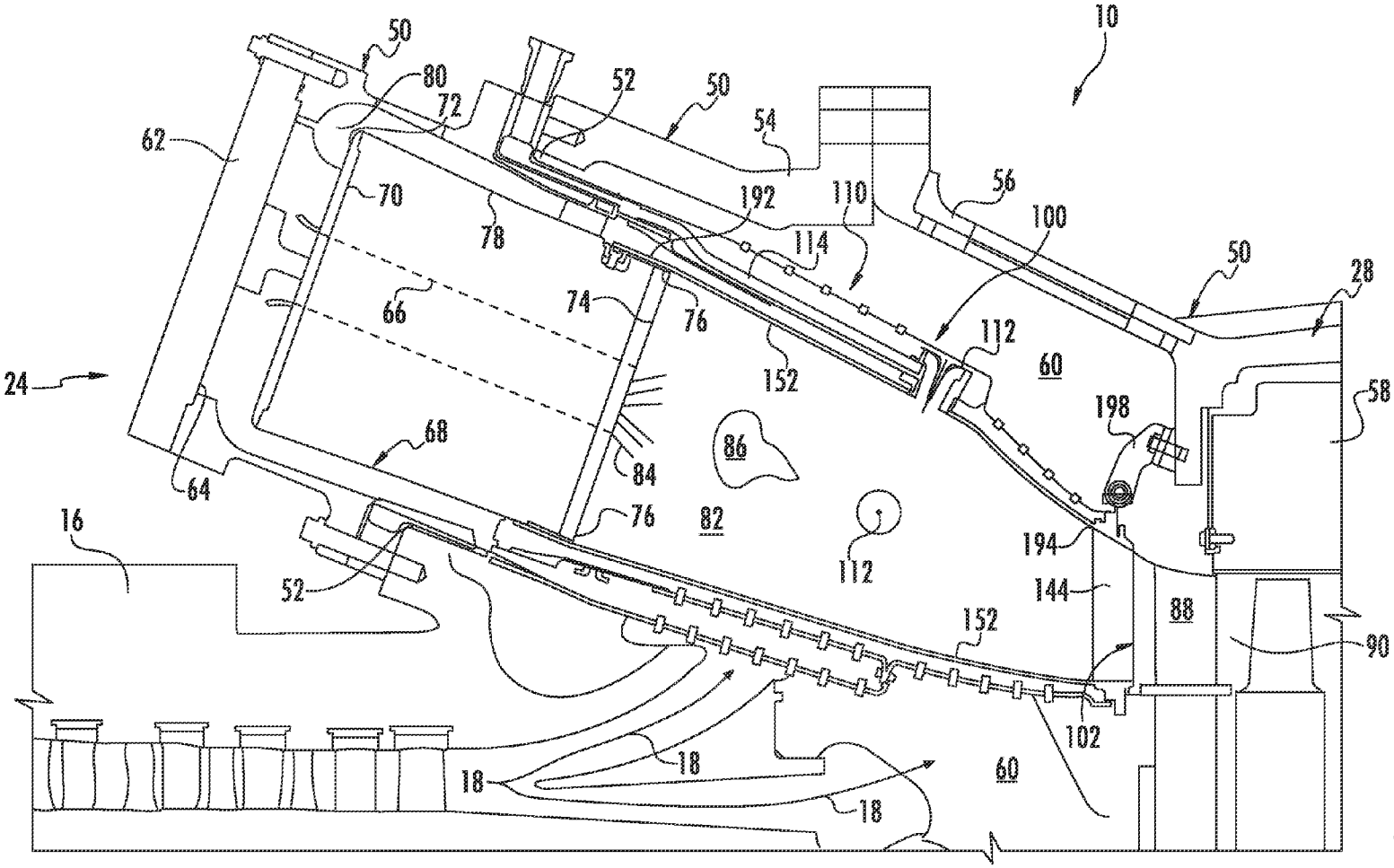
FIG. 2 is a cross-section side view of a portion of an exemplary gas turbine according to various embodiments of the present invention.

FIG. 2 provides a cross-section side view of a portion of the gas turbine 10 according to various embodiments of the present invention. As shown in FIG. 2, the gas turbine 10 generally includes an outer casing 50 that at least partially surrounds the combustor 24. The outer casing 50 at least partially defines an opening 52 for installing and/or supporting the combustor 24. In particular embodiments, the outer casing 50 comprises of a first outer casing 54 such as a compressor discharge casing and second outer casing 56 such as an outer turbine shell. The first and the second outer casings 54, 56 at least partially encase the combustor 24. In particular embodiments, the turbine 28 further includes an inner turbine shell or casing 58 that is at least partially surrounded by the second outer casing 56. The outer casing 50 at least partially defines a high pressure plenum 60 that at least partially surrounds at least a portion of the combustor 24. The high pressure plenum 60 is in fluid communication with the compressor 16.

As shown in FIG. 2, the combustor 24 generally includes a radially extending end cover 62 that is connected to the outer casing 50 at one end of the combustor 24. The end cover 62 is generally in fluid communication with the fuel supply 22 (FIG. 1). As shown in FIG. 2, the end cover 62 includes an inner surface 64. At least one axially extending fuel nozzle 66 extends downstream from the inner surface 64 of the end cover 62 within the outer casing 50. An annular cap assembly 68 extends radially and axially within a portion of the outer casing 50. The cap assembly 68 is disposed generally downstream from the end cover 62.

The cap assembly 68 generally includes a radially extending base plate 70 disposed at a forward or upstream end 72 of the cap assembly 68, a radially extending cap plate 74 disposed at an aft or downstream end 76 of the cap assembly 64, and one or more annular shrouds 78 that extend at least partially between the base plate 70 and the cap plate 74. The end cover 62, the outer casing 50 and the cap assembly 68 at least partially define a head end plenum 80 within the combustor 24. The axially extending fuel nozzle(s) 66 extends at least partially through the cap assembly 68 to provide fluid communication between the end cover 62 and/or the fuel supply 22 (FIG. 1) and a combustion chamber 82 that is disposed downstream from the cap plate 74. In this manner, a combustible mixture 84 that consist in part of a portion of the compressed working fluid 18 flowing from the compressor 16 and the fuel 20 from the fuel supply 22 (FIG. 1) may flow from the axially extending fuel nozzle 66 into the combustion chamber 82 for combustion within a primary combustion zone 86 that is defined within the combustion chamber 82. The gas turbine 10 further includes a first stage of stationary nozzles 88 that at least partially define an inlet 90 to the turbine 28.

In particular embodiments, as shown in FIG. 2, the combustor 24 includes a combustion module 100 that extends through the opening 52 in the outer casing 50. At least a portion of the combustion module 100 circumferentially surrounds at least a portion of the cap assembly 68. When installed into the combustor 24, an aft or downstream end 102 of the combustion module 100 generally terminates upstream from and/or adjacent to the first stage of stationary nozzles 88.

Figure 3:
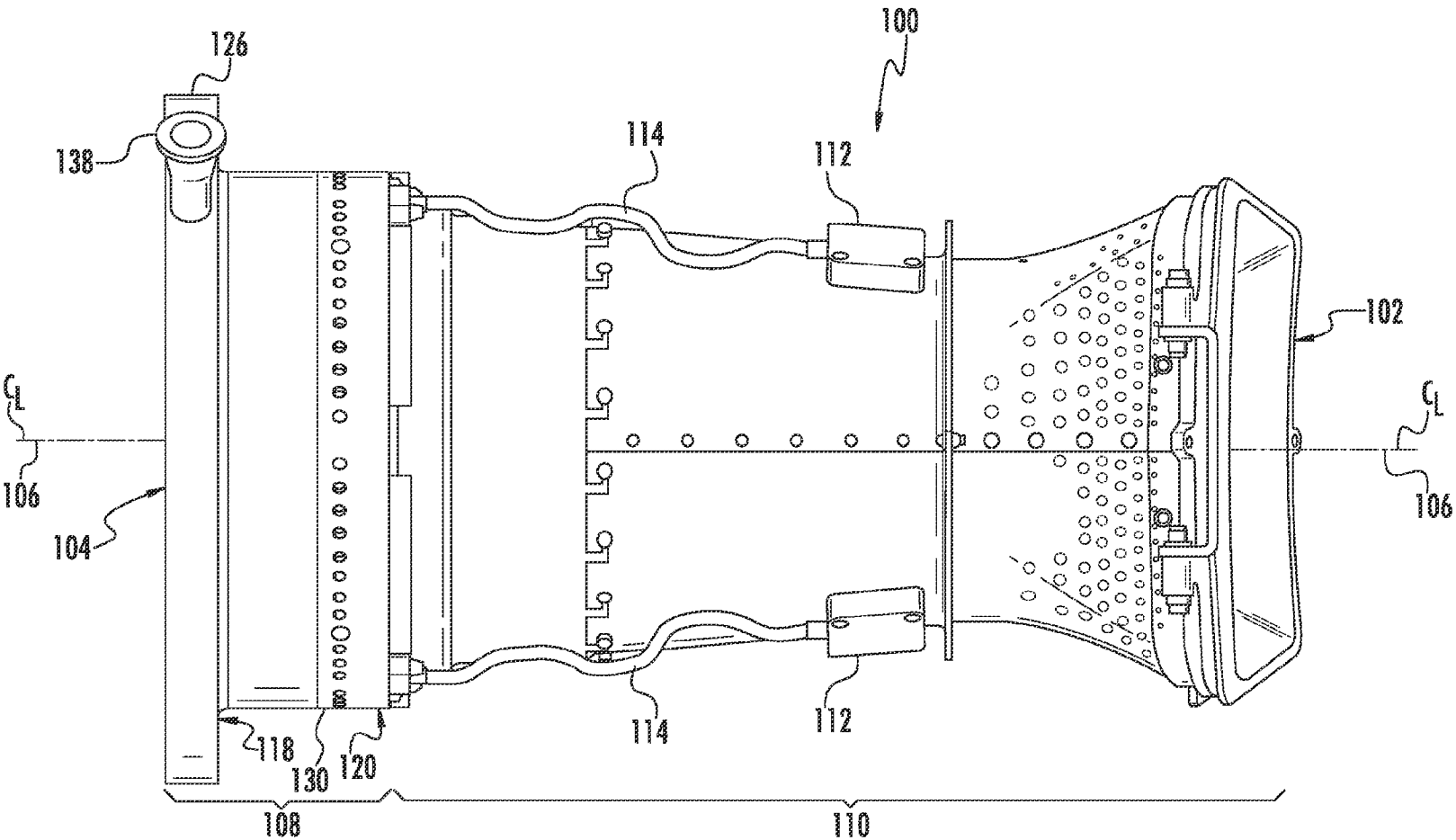
FIG. 3 is a top view of a combustion module as shown in FIG. 2, according to at least one embodiment of the present disclosure.
Figure 4:
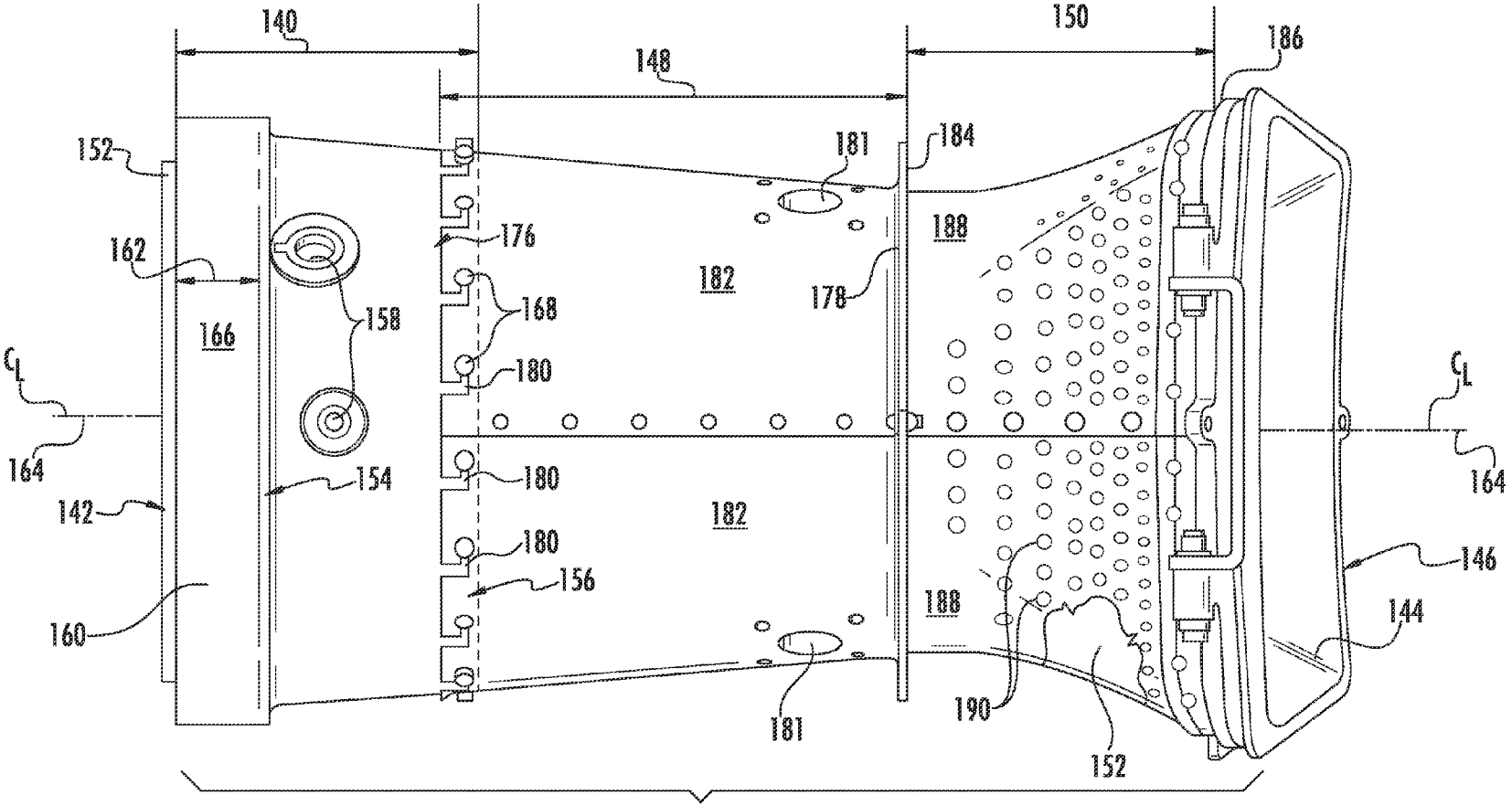
FIG. 4 is a top view of a flow sleeve assembly portion of the combustion module as shown in FIG. 3, according to at least one embodiment of the present invention.
Figure 5:
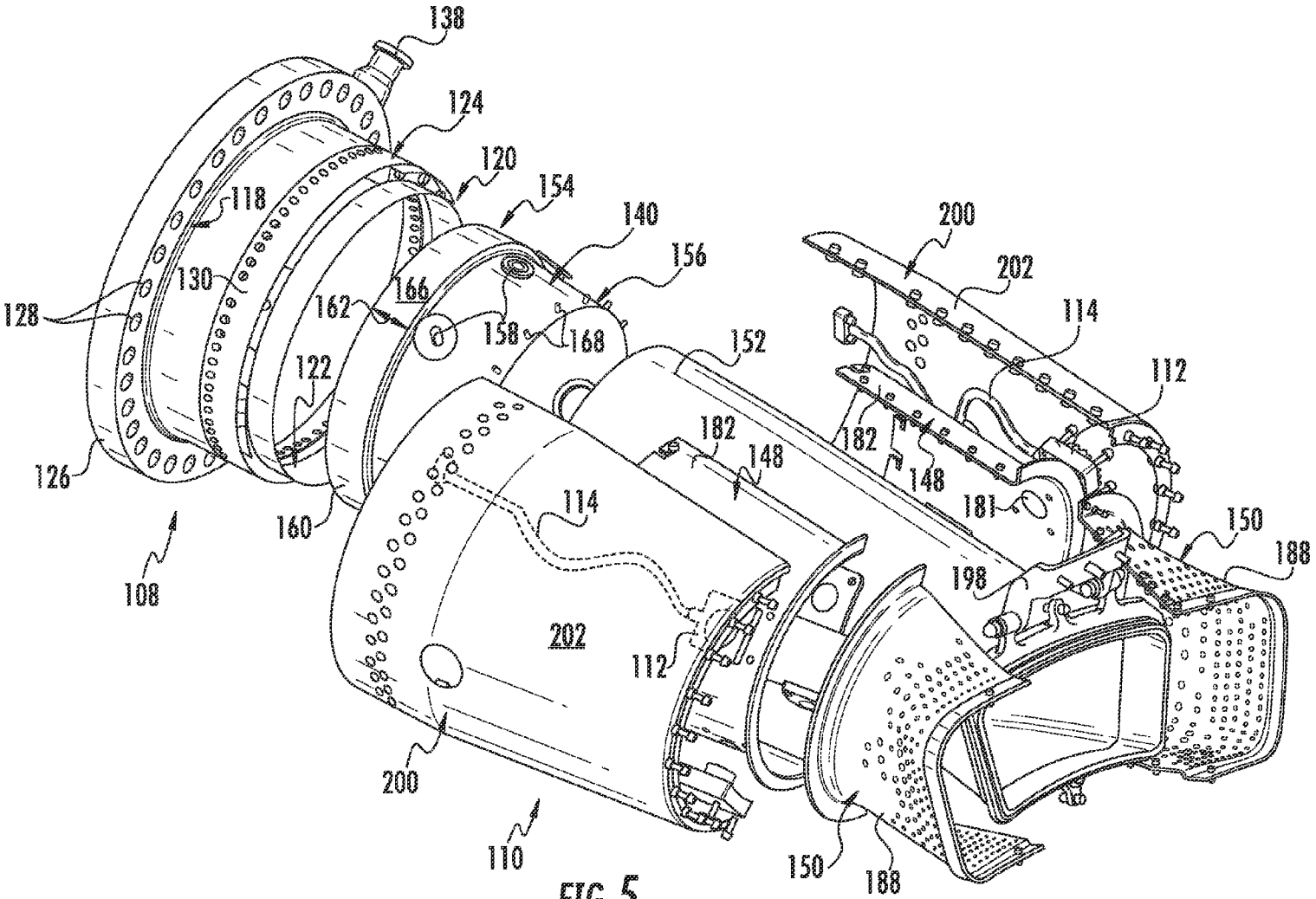
FIG. 5 is an exploded perspective view of the combustion module as shown in FIG. 3, according to at least one embodiment of the present invention.
Figure 6:
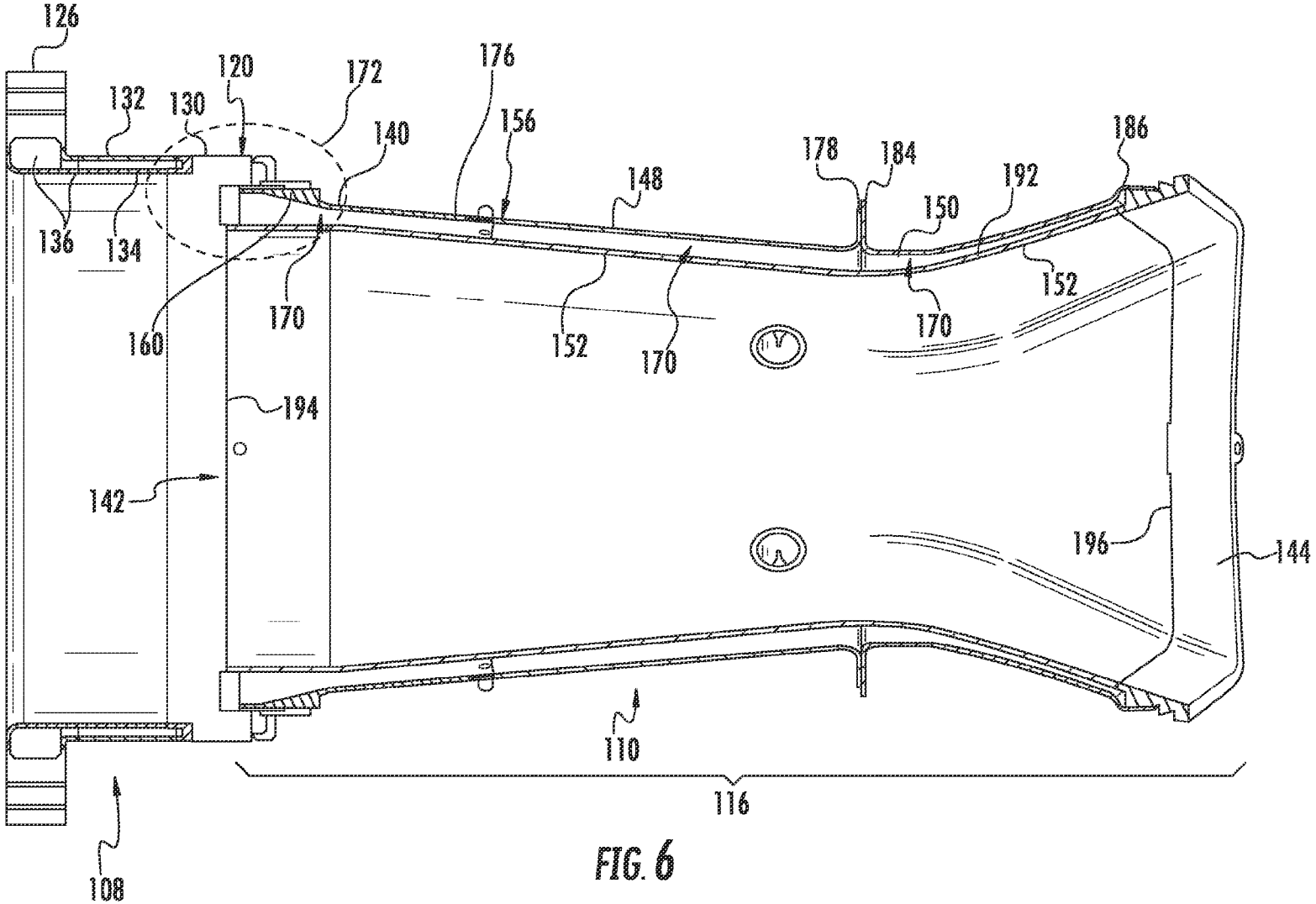
FIG. 6 is a cross section top view of the flow sleeve assembly as shown in FIG. 4, according to at least one embodiment of the present invention.

FIG. 3 provides, a top view of the combustion module 100 according to at least one embodiment of the present disclosure, FIG. 4 provides a top view of a portion of the combustion module as shown in FIG. 3 according to at least one embodiment, FIG. 5 provides an exploded perspective view of the combustion module 100 as shown in FIG. 3, and FIG. 6 provides a cross sectional top view of the combustion module 100 as shown in FIG. 3. As shown in FIG. 3, the combustion module 100 generally includes a forward or upstream end 104 that is axially separated from the aft end 102 with respect to an axial centerline 106 of the combustion module 100.

The combustion module 100 generally includes an annular fuel distribution manifold 108 disposed at the forward end 104 of the combustion module 100 and a fuel injection assembly 110 that extends downstream from the fuel distribution manifold 108 and terminates at the aft end 102 of the combustion module 100. As shown in FIGS. 2 and 3, the fuel injection assembly 110 includes at least one fuel injector(s) 112 that extends generally radially through a portion of the fuel injection assembly 110 and at least one fluid conduit 114 that fluidly couples and/or connects the fuel injector(s) 112 to the fuel distribution manifold 108. In various embodiments, as shown in FIG. 4 the fuel injection assembly 110 includes a flow sleeve assembly 116.

As shown in FIG. 5, the fuel distribution manifold 108 generally includes a forward or upstream end 118, an aft or downstream end 120 that is axially separated from the forward end 118, an inner side portion 122 that is radially separated from an outer side portion 124. A radially extending mounting flange 126 extends circumferentially around the forward end 118. The mounting flange 126 may include a plurality of fastener holes 128 for connecting the mounting flange 126 to the outer casing 50 (FIG. 2). As shown in FIG. 2, the mounting flange 126 may be connected to the outer casing 50 such as the compressor discharge casing 54. As shown in FIGS. 3 and 5, the fuel distribution manifold 108 may further include an annular support ring 130 that at least partially defines the aft end 120 of the fuel distribution manifold 108. The support ring 130 may at least partially define the inner side portion 122 (FIG. 3) and/or the outer side portion 124 (FIG. 3) of the fuel distribution manifold 108.

As shown in FIG. 6, the fuel distribution manifold 108 may include an annular outer sleeve 132 and an annular inner sleeve 134. The outer sleeve 132 circumferentially surrounds at least a portion of the inner sleeve 134 to at least partially define a fuel plenum 136 therebetween. The outer and the inner sleeves 132, 134, may generally extend between the mounting flange 126 and the support ring 130 and/or the aft end 120 of the fuel distribution manifold 108. As shown in FIGS. 3 and 5, the mounting flange 126 may further include a fuel inlet port 138. The fuel inlet port 138 generally provides for fluid communication between the fuel supply 20 (FIG. 1) and the fuel plenum 136 (FIG. 6).

In particular embodiments, as shown in FIG. 4, the flow sleeve assembly 116 comprises an annular support sleeve 140 disposed at a forward end 142 of the flow sleeve assembly 116, an aft frame 144 that is disposed at an aft end 146 of the flow sleeve assembly 116, an annular flow sleeve 148 that extends axially from the support sleeve 140 towards the aft frame 144, and an annular impingement sleeve 150 that extends between the flow sleeve 148 and the aft frame 144. In particular embodiments, the flow sleeve assembly 116 further comprises an annular combustion liner or duct 152. The combustion liner 152 is at least partially surrounded by the support sleeve 140, the flow sleeve 148 and the impingement sleeve 150.

As shown in FIGS. 4 and 5, the support sleeve 140 generally includes a forward portion 154 that is positioned adjacent to the forward end 142 of the flow sleeve assembly 116. The support sleeve 140 further includes an aft portion 156 that is axially separated from the forward portion 154. In particular embodiments, the support sleeve 140 at least partially defines one or more openings 158 that extend substantially radially through the support sleeve 140. The one or more openings 158 may allow for insertion of a spark plug, a cross fire tube, a camera or other device through the support sleeve 140. In particular embodiments, the support sleeve 140 includes a radially extending flange 160. The flange 160 extends circumferentially around the forward portion 154 of the support sleeve 140. The flange 160 has an axial length 162 with respect to an axial centerline 164 (FIG. 4) of the flow sleeve assembly 116. The flange 160 defines an outer engagement surface 166 that extends at least partially across the axial length 162 of the flange 160. In particular embodiments, as shown in FIG. 5, a plurality of fastening features 168 such as tabs, bolts or bosses extend radially outward from and/or through the support sleeve 140 generally adjacent to the aft portion 156 of the support sleeve 140. In particular embodiments, as shown in FIG. 6, the support sleeve 140 is radially separated from the combustion liner 152 so as to at least partially define an annular cooling flow passage 170 therebetween.

Figure 7:
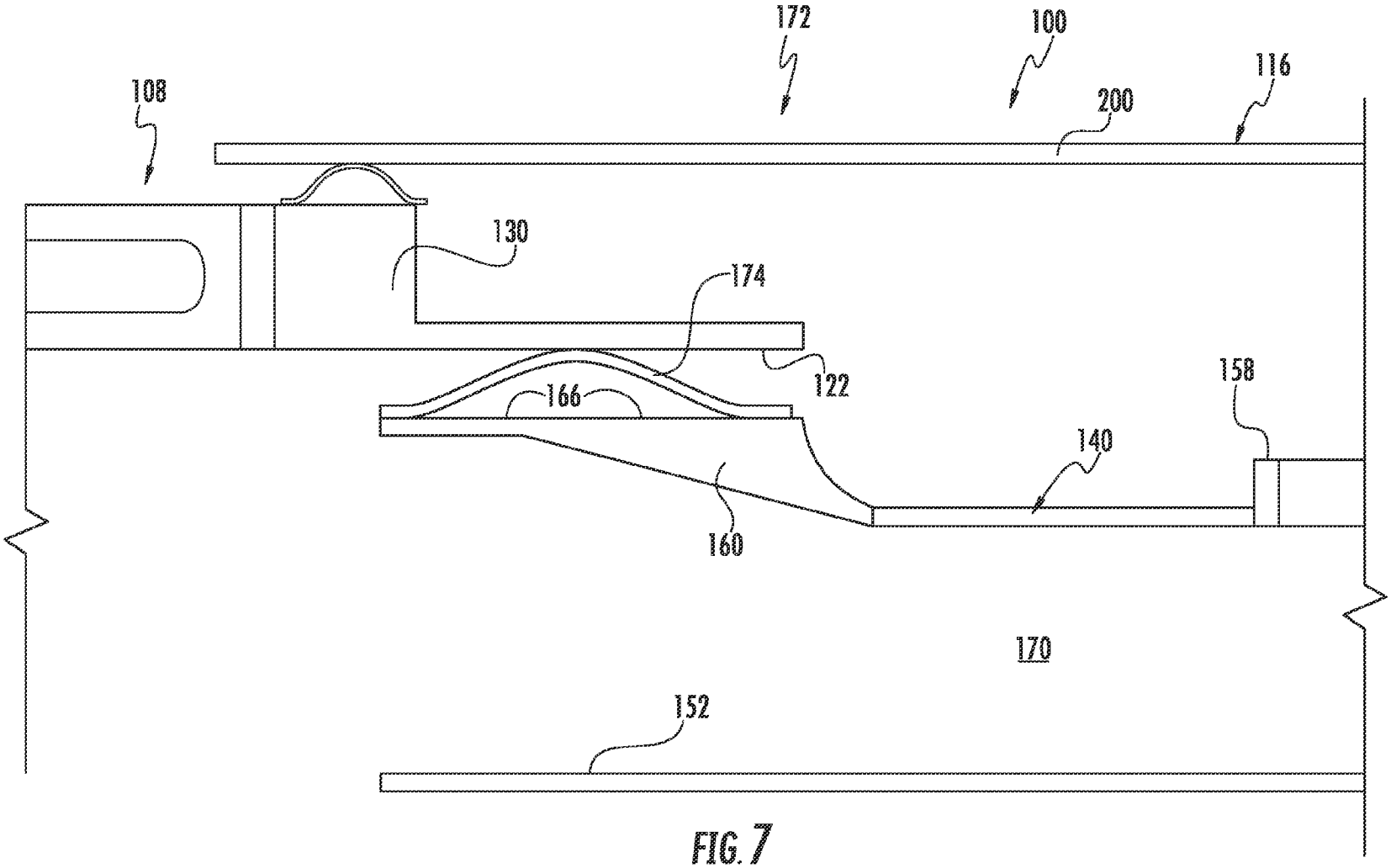
FIG. 7 is an enlarged view of a portion of the cross section top view of the flow sleeve assembly as shown in FIG. 6, according to at least one embodiment of the present invention.

FIG. 7 provides an enlarged view of a portion of the combustion module 100 as shown within the dashed line 172 in FIG. 6. In particular embodiments, as shown in FIGS. 6 and 7, at least a portion of the flange 160 is positioned concentrically within the fuel distribution manifold 108 such that the outer engagement surface 166 is radially separated from the inner side portion 122 of the fuel distribution manifold 108. In this manner, the support sleeve 140 is allowed to slide or translate along the inner side portion 122 of the fuel distribution manifold 108 during operation of the combustor 24. In particular embodiments, as shown in FIG. 7, the flow sleeve assembly 116 further includes a compression or spring seal 174 such as a hula seal that extends radially between the outer engagement surface 166 of the flange 160 and the inner side portion 122 of the fuel distribution manifold 108 and/or the support ring 130. In particular embodiments, the spring seal 174 may be connected to the support sleeve 140. In the alternative, the spring seal 174 may be connected to the fuel distribution manifold 108. The spring seal 174 at least partially provides structural support for the flow sleeve assembly 140 during installation and/or operation of the gas turbine 10 while allowing for axial movement between the fuel distribution manifold 108 and the flow sleeve assembly 116 during various operational modes of the gas turbine 10. The spring seal 174 may generally limit radial movement between the flow sleeve assembly 116 and the fuel distribution manifold 108. For example, the spring seal 174 may allow for relative axial and limited radial movement between the flow sleeve assembly 116 and the fuel distribution manifold 108 as the gas turbine 10 transitions through various thermal transient conditions such as during startup, shutdown and/or turndown operation.

As shown in FIGS. 4 and 6, the flow sleeve 148 extends from the aft portion 156 of the support sleeve 140 towards the aft frame 144. As shown in FIG. 4, the flow sleeve 148 generally includes a forward end 176 that is axially separated from an aft end 178. The forward end 176 of the flow sleeve 148 circumferentially surrounds the aft portion 156 of the support sleeve 140. In particular embodiments, as shown in FIG. 4, a plurality of locking channels or slots 180 are disposed generally adjacent to the forward end 176 of the flow sleeve 148. The locking channels 180 may be engaged with the fastening features 168 of the support sleeve 140 so as to couple the forward end 176 of the flow sleeve 148 to the support sleeve 140. In particular embodiments, the flow sleeve may at least partially define a fuel injector passage 181. As shown in FIG. 3, the fuel injector 112 may extend through the fuel injector passage 181.

As shown in FIG. 6, the flow sleeve 148 is radially separated from the combustion liner 152 so as to at least partially define the annular cooling flow passage 170. In particular embodiments, as shown in FIGS. 4 and 5, the flow sleeve 148 comprises two or more semi-annular flow sleeve sections 182. The two or more semi-annular flow sleeve sections 182 may be connected or joined by any mechanical means suitable for the operating environment of the combustor 24. For example, the two or more semi-annular flow sleeve sections 182 may be connected with mechanical fasteners and/or by welding.

In particular embodiments, as shown in FIGS. 4 and 6, the annular impingement sleeve 150 extends between the aft end 178 of the flow sleeve 148 and the aft frame 144. The impingement sleeve 150 generally includes a forward end 184 that is connected to the aft end 178 of the flow sleeve 148 and an aft end 186 that is connected to the aft frame 144. The impingement sleeve 150 may be connected to the aft end 178 of the flow sleeve 148 and/or to the aft frame 144 by any mechanical means suitable for the operating environment of the combustor 24 such as mechanical fasteners and/or welding. In particular embodiments, as shown in FIGS. 4 and 5, the impingement sleeve 150 is formed from two or more semi-annular impingement sleeve sections 188 that are joined together by any mechanical means suitable for the operating environment of the combustor 24 such as mechanical fasteners and/or welding. In particular embodiments, as shown in FIGS. 4 and 5, the impingement sleeve 150 at least partially surrounds a portion of the combustion liner 152 so as to at least partially define the cooling flow passage 170 (FIG. 6) therebetween. As shown in FIG. 4, the impingement sleeve 150 generally includes a plurality of cooling holes 190 that extend through the impingement sleeve 150. The cooling holes 190 provide for fluid communication of a portion of the compressed working fluid 18 (FIG. 2) between the high pressure plenum 60 (FIG. 2) and the cooling flow passage 170 (FIG. 6). In this manner, the compressed working fluid 18 is directed against an outer or cool side 192 of the combustion liner 152 that is surrounded by the impingement sleeve 150, thereby providing for impingement cooling a portion of the combustion liner 152 that is surrounded by the impingement sleeve 150. The compressed working fluid 18 then flows through the cooling flow passage 170 to provide at least one of conductive or convective cooling to the remainder of the outer side 192 of the combustion liner 152 that is surrounded by the flow sleeve 148 and the support sleeve 140 as the compressed working fluid 18 is routed through the cooling flow passage 170 towards the head end plenum 80 (FIG. 2) of the combustor 24.

As shown in FIG. 6, the combustion liner 152 includes a forward end 194 that is disposed generally adjacent to the forward end 142 of the flow sleeve assembly 116 and an aft end 196 that terminates at the aft frame 144. As shown in FIG. 2, the forward end 194 of the combustion liner 152 at least partially surrounds at least a portion of the downstream end 76 of the cap assembly 68. In particular embodiments, as shown in FIG. 6, the aft end 196 of the combustion liner 152 is connected to the aft frame 144. The aft end 196 of the combustion liner 152 may be connected to the aft frame 144 by any mechanical means suitable for the operating environment of the combustor 24 such as mechanical fasteners and/or welding. In the alternative, the aft frame 144 may circumferentially surround the aft end 196 of the combustion liner 152. For example, the aft frame 144 and the combustion liner 152 may be cast as a singular component.

As shown in FIGS. 2 and 5, a mounting bracket 198 may be connected to the aft frame 144. The mounting bracket 198 may pivot in a forward direction and/or aft direction with respect to an axial centerline of the flow sleeve assembly 116 and or the combustion module 100. In particular embodiments, as shown in FIG. 2 the aft frame 144 is connected to the outer casing 50 such as the outer turbine casing 56 via the mounting bracket 198. This mounting scheme generally results in relative movement between the fuel distribution manifold 108 and the flow sleeve assembly 116, particularly between the support sleeve 140 and the inner side portion 122 of the fuel distribution manifold 108, as the combustor 24 and/or the gas turbine 10 transitions between various thermal transient conditions such as during startup, shutdown and/or turndown operation. However, radial clearance provided between the outer engagement surface 166 of the flange 160 of the support sleeve 140 and the inner side portion 122 of the fuel distribution manifold 108 accommodates for this movement while providing continuous support to the flow sleeve assembly. In addition, the spring seal 174 reduces and/or prevents radial movement between the outer engagement surface 166 of the flange 160 of the support sleeve 140 and the inner side portion 122 of the fuel distribution manifold 108, thereby reducing and/or preventing damage to the flow sleeve assembly 116 and/or the fuel distribution manifold 108 during operation of the combustor 24. As a result, the overall reliability and mechanical performance of the combustion module 100 and/or the combustor 24 may be improved.

As shown in FIG. 5, the flow sleeve assembly 116 may further include an annular outer flow sleeve or air shield 200. The outer flow sleeve 200 circumferentially surrounds at least a portion of the flow sleeve 148 and the support sleeve 140. In one embodiment, the outer flow sleeve 200 is formed from two or more semi-annular outer flow sleeve sections 202 that are joined together by fasteners and/or by any other mechanical means suitable for the operating environment of the combustor 24. The outer flow sleeve 200 my route a portion of the compressed working fluid 18 from the high pressure plenum 60 (FIG. 2) to the fuel injectors 112 while simultaneously providing cooling to the flow sleeve 148 and/or the support sleeve 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A flow sleeve assembly for a combustor of a gas turbine, comprising:

a. an annular support sleeve disposed at a forward end of the flow sleeve assembly, the support sleeve having a forward portion axially separated from an aft portion, wherein the support sleeve includes an annular flange having an axial length, the flange extending circumferentially around the forward portion of the support sleeve, the flange being positioned concentrically within a fuel distribution manifold such that the flange slides along an inner side portion of the fuel distribution manifold during operation of the combustion module;

b. an aft frame disposed at an aft end of the flow sleeve assembly;

c. an annular flow sleeve that extends from the aft portion of the support sleeve towards the aft frame, the flow sleeve having a forward end axially separated from an aft end, the forward end of the flow sleeve circumferentially surrounding the aft portion of the support sleeve; and d. an annular impingement sleeve that extends between the aft end of the flow sleeve and the aft frame, the impingement sleeve having a forward end that is connected to the aft end of the flow sleeve and an aft end that is connected to the aft frame.

2. The flow sleeve assembly as in claim 1, wherein the support sleeve at least partially defines an opening that extends radially through the support sleeve so as to provide access through the support sleeve.

3. The flow sleeve assembly as in claim 1, further comprising a plurality of fastening features that extend radially outward from the support sleeve, the fastening features being arranged circumferentially around the aft portion of the support sleeve.

4. The flow sleeve assembly as in claim 1, wherein the flow sleeve comprises of a first semi-annular flow sleeve section that is connected to a second semi-annular flow sleeve section.

5. The flow sleeve assembly as in claim 1, wherein the flow sleeve at least partially defines a plurality of locking channels disposed at the forward end of the flow sleeve.

6. The flow sleeve assembly as in claim 1, wherein the impingement sleeve comprises of a first semi-annular impingement sleeve section connected to a second semi-annular impingement sleeve section.

7. The flow sleeve assembly as in claim 1, further comprising an annular combustion liner that is at least partially circumferentially surrounded by the support sleeve, the flow sleeve and the impingement sleeve, the combustion liner having an aft end that is connected to the aft frame and a forward end that terminates adjacent to the forward portion of the support sleeve.

8. The flow sleeve assembly as in claim 7, further comprising a cooling flow passage defined between the combustion liner and the impingement sleeve, the flow sleeve and the support sleeve.

9. A combustion module for a combustor, comprising:

a. an annular fuel distribution manifold, the fuel distribution manifold having a forward end axially separated from an aft end; and b. a fuel injection assembly that extends downstream from the fuel distribution manifold, the fuel injection assembly having an annular combustion liner that extends between a forward end and an aft end of the fuel injection assembly and an annular flow sleeve assembly that circumferentially surrounds the combustion liner, the flow sleeve assembly comprising:

i. an annular support sleeve disposed at a forward end of the flow sleeve assembly, the support sleeve having a forward portion axially separated from an aft portion, wherein the support sleeve includes an annular flange having an axial length, the flange extending circumferentially around the forward portion of the support sleeve, the flange being positioned concentrically within the fuel distribution manifold such that the flange slides along an inner side portion of the fuel distribution manifold during operation of the combustion module;

ii. an aft frame disposed at an aft end of the flow sleeve assembly;

iii. an annular flow sleeve that extends from the aft portion of the support sleeve towards the aft frame, the flow sleeve having a forward end axially separated from an aft end; and iv. an annular impingement sleeve that extends between the aft end of the flow sleeve and the aft frame, the impingement sleeve having a forward end that is connected to the aft end of the flow sleeve and an aft end that is connected to the aft frame.

10. The combustion module as in claim 9, wherein the support sleeve at least partially defines an opening that extends radially through the support sleeve so as to provide access through the support sleeve.

11. The combustion module as in claim 9, further comprising a plurality of fastening features that extend radially outward from the support sleeve, the fastening features being arranged circumferentially around the aft portion of the support sleeve.

12. The combustion module as in claim 9, wherein the flow sleeve comprises of a first semi-annular section connected to a second semi-annular section.

13. The combustion module as in claim 9, wherein the flow sleeve at least partially defines a plurality of locking channels disposed at the forward end of the flow sleeve.

14. The combustion module as in claim 9, wherein the impingement sleeve comprises of a first semi-annular impingement sleeve section connected to a second semi-annular impingement sleeve section.

15. A gas turbine, comprising:

a. a compressor disposed at an upstream end of the gas turbine, a combustor disposed downstream from the compressor, a turbine disposed downstream from the combustor; and b. a combustion module that extends at least partially through the combustor, the combustion module including an annular fuel distribution manifold having a forward end axially separated from an aft end and a fuel injection assembly that extends downstream from the fuel distribution manifold, the fuel injection assembly having an annular combustion liner that extends between a forward end and an aft end of the fuel injection assembly and an annular flow sleeve assembly that circumferentially surrounds the combustion liner, the flow sleeve assembly comprising:

i. an annular support sleeve disposed at a forward end of the flow sleeve assembly, the support sleeve having a forward portion axially separated from an aft portion, wherein the support sleeve includes an annular flange having an axial length, the flange extending circumferentially around the forward portion of the support sleeve, the flange being positioned concentrically within the fuel distribution manifold such that the flange slides along an inner side portion of the fuel distribution manifold during operation of the combustion module;

ii. an aft frame disposed at an aft end of the flow sleeve assembly;

iii. an annular flow sleeve that extends from the aft portion of the support sleeve towards the aft frame, the flow sleeve having a forward end axially separated from an aft end; and iv. an annular impingement sleeve that extends between the aft end of the flow sleeve and the aft frame, the impingement sleeve having a forward end that is connected to the aft end of the flow sleeve and an aft end that is connected to the aft frame.

16. The gas turbine as in claim 15, further comprising a plurality of fastening features that extend radially outward from the support sleeve, the fastening features being arranged circumferentially around the aft portion of the support sleeve.

17. The gas turbine as in claim 15, wherein the flow sleeve at least partially defines a plurality of locking channels disposed at the forward end of the flow sleeve.

18. The gas turbine as in claim 15, wherein the flow sleeve comprises of a first semi-annular flow sleeve section connected to a second semi-annular flow sleeve section, and the impingement sleeve comprises of a first semi-annular impingement sleeve section connected to a second semi-annular impingement sleeve section.

* * * * *